US006089884A

United States Patent [19]

Klaus

[11] Patent Number: 6,089,884

[45] Date of Patent: Jul. 18, 2000

[54] TRACK LIGHTING SYSTEM

[75] Inventor: Dale A. Klaus, St. Louis, Mo.

[73] Assignee: Dal Partnership, St Louis, Mo.

[21] Appl. No.: 08/889,921

[22] Filed: Jul. 10, 1997

[51] Int. Cl.[7] ..... H01R 25/00

[52] U.S. Cl. ..... 439/117; 439/118; 362/226

[58] Field of Search ..... 439/110–119, 665; 362/226, 227, 239

[56] References Cited

U.S. PATENT DOCUMENTS

| | | | |
|---|---|---|---|
| D. 331,294 | 11/1992 | Wereley . | |
| D. 355,501 | 2/1995 | Roos et al. . | |
| 3,801,951 | 4/1974 | Kemmerer et al. . | |
| 4,096,349 | 6/1978 | Donato . | |
| 4,099,817 | 7/1978 | Booty . | |
| 4,622,624 | 11/1986 | McCarthy et al. . | |
| 4,783,724 | 11/1988 | Wilson et al. . | |
| 4,861,273 | 8/1989 | Wenman et al. . | |
| 5,128,847 | 7/1992 | Lin et al. | 439/118 X |
| 5,259,774 | 11/1993 | Gabrius . | |
| 5,325,281 | 6/1994 | Harwood . | |
| 5,336,100 | 8/1994 | Gabrius . | |
| 5,426,572 | 6/1995 | Weinstock et al. . | |

FOREIGN PATENT DOCUMENTS

| | | |
|---|---|---|
| 517318 | 1/1940 | United Kingdom . |
| 94/24731 | 10/1994 | WIPO . |

OTHER PUBLICATIONS

Tresco International Ltd. Co., "Tresco–12" (Commercial/Residential Halogen Track Lighting) May 1995.

*Primary Examiner*—Khiem Nguyen
*Attorney, Agent, or Firm*—Polster, Lieder, Woodruff & Lucchesi

[57] ABSTRACT

A track-lighting system of the present invention includes an electrically conductive track, a power supply being adapted to be mounted to the track at a desired position along the track to energize the track, and at least one lighting fixture adapted to be mounted to the track at a desired position along the track. The lighting fixture is independent of the power supply and is electrically connected to the power supply by the electrically conductive track to be powered by the power supply. The track, lighting fixtures and power supply are sized to be mounted beneath an elevated cabinet, such as a kitchen cabinet. The track, the power supply, and lighting fixture are therefore sized and shaped to be substantially flush with a bottom of the lip of the cabinet when the track lighting system is mounted to the cabinet. In one embodiment, the power supply is provided with a wire splice compartment which enables two or more power supplies to be electrically connected in parallel.

8 Claims, 6 Drawing Sheets

TRACK LIGHTING SYSTEM

CROSS-REFERENCE TO RELATED APPLICATIONS

The ornamental appearance of the components of the tracking lighting system are shown in U.S. Pat. No. D400,167 entitled "Track Lighting Power Supply" and U.S. Pat. No. D404,159 entitled "Undercabinet Lighting fixture", both of which are incorporated herein by reference.

BACKGROUND OF THE INVENTION

This invention relates to under cabinet track-lighting, and in particular, to a low profile under cabinet light.

Track lighting is well known and commonly used in the lighting of rooms in a house. Track lighting typically includes an electrically conductive track and fixtures which are mounted to the track. A low-voltage transformer is provided at one end of the track to connect the track to a source of electricity, such as an electrical outlet in the house or an electrical circuit in the house. The transformers are generally mounted in a remote location or to the ends of the track. In some fixtures, independent power supplies are included. Thus, the light fixtures are generally large. Because of this, the track light fixtures cannot be made to be small enough to be mounted flush against a surface, such as the underside of a cabinet.

Further, because the power source (i.e., the transformer) which energizes the track is positioned at the end of the track, power is lost along the track due to the resistance of the track.

BRIEF SUMMARY OF THE INVENTION

One object of the invention is to provide a track lighting system which includes light fixtures and a power supply.

Another object of the invention is to provide such a track lighting system in which the power supply is separate from the light fixtures.

A further object is to provide such a track lighting system in which the power supply can be positioned anywhere along the length of the track.

These and other objects will become apparent to those skilled in the art in light of the following disclosure and accompanying drawings.

Briefly stated, a track-lighting system of the present invention includes an electrically conductive track, a power supply adapted to be mounted to the track at a desired position along the track to energize the track, and at least one lighting fixture adapted to be mounted to the track at a desired position along the track. The only support for the power supply is the track. The power supply is not physically connected to the mounting surface by the use of screws or other fasteners, however, a screw hole is provided so that it can be secured to the mounting surface if desired. The lighting fixture is independent of the power supply and is electrically connected to the power supply by the electrically conductive track to be powered by the power supply. The track, lighting fixtures and power supply are preferably sized to be mounted beneath an elevated cabinet, such as a kitchen cabinet. The track, the power supply, and lighting fixture are therefore sized and shaped to be substantially flush with a bottom of the lip of the cabinet when the track lighting system is mounted to the cabinet.

The track includes a top wall, a bottom wall, and a side wall defining a main channel extending the length thereof.

At least two grooves are formed in each of the top wall and bottom wall. An electrically conductive element is positioned in the groove adjacent the top or bottom wall of the track.

The power supply includes a housing, a power cord extending from the housing to connect the power supply to a source of electricity, a rotatable mounting arm extending from the housing to be received in the channel, and a pivotal locking arm which extends from the mounting arm to enable an installer to rotate the mounting arm. The mounting arm includes two spaced apart flanges which extend radially from the arm. The flanges are sized to be received in the grooves of the track and have a width substantially less than the height of the channel and a height (from top to bottom) which is only slightly less than the height of the channel. An electrical contact extends from each flange to engage the electrically conductive elements in the track grooves when the power supply is mounted in the track. The height of the flange and the contacts in combination approximately equals the height of the track channel.

The lighting fixture includes a housing, a lamp in the housing, a rotatable mounting arm extending from the housing to be received in the channel, and a pivotable locking arm which extends from the mounting arm and is operable to rotate the mounting arm. The mounting arm of the lighting fixture is identical to the mounting arm of the power supply.

The mounting arms of the power supply and the lighting fixture are rotatable between a first position in which the flanges are generally parallel to the track grooves and a second position in which the flanges are generally perpendicular to the track grooves. In the first position the electrical contacts of the mounting arms are not in electrical contact with the track, and the mounting arm of a component of the track lighting system (i.e., the power supply or a lighting fixture) can be inserted in the channel, and the component can be moved along the track to a desired position along the track. In the second position, the size of the flange plus the electrical contacts cause the contacts to bear against the track to create a friction fit to fix the component in place on the track and to electrically connect the component to the track.

The track lighting system is provided with an electrical connector to electrically connect two pieces of track together such that a single power supply can energize all of the track which is made part of the installed lighting system. The electrical connector includes a pair of endpieces electrically connected by an electrical wire. Each end piece is sized and shaped to be received in the ends of the track and includes spaced apart ribs sized and shaped to be received in the grooves of the track, and an electrical contact extending from the rib to be placed in electrical contact with the electrically conductive element of the track when the connector is applied to the track. The connector end pieces are force fit in the ends of the track to mount the endpieces to the track.

In a second embodiment of the power supply, the power supply is provided with a wire splice compartment which has a pair of electrical contacts therein. The contacts are electrically connected to the electrical circuit of the power supply. Rather than being connected to an outlet, the wire splice enables one power supply to be wired directly into an electrical circuit in the house. The provision of the wire splice compartment allows for two or more power supplies to be connected in parallel. Thus, a number of independent tracks can each be powered by a separate power supply, with a single connection to an electrical circuit in the house.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 4:
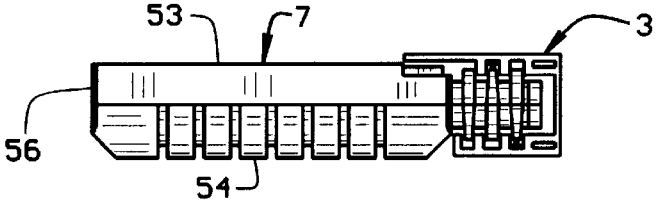
FIG. 4 is a side elevational view of a light fixture of the track lighting system mounted in the track.

A track lighting system 1 of the present invention is shown mounted to the underside of a raised or elevated cabinet C, such as a cabinet above a kitchen counter. The cabinet C includes doors D which extend below the bottom B of the cabinet to define a lip. The track lighting system is mounted to the cabinet bottom B and includes an electrically conductive track 3, a power supply 5 which energizes the track 3, and lighting fixtures 7. The track 3, power supply 5, and lighting fixtures 7 are all shaped and sized such that when they are mounted to the cabinet, the lower surfaces of the components are generally flush with the bottom of the cabinet lip. The thin line appearance of the lighting fixture 7 when mounted to the track can be seen in FIG. 4. The track lighting system 1 thus occupies very little of the space above the kitchen counter, leaving the counter free for larger kitchen appliances.

Figure 2:
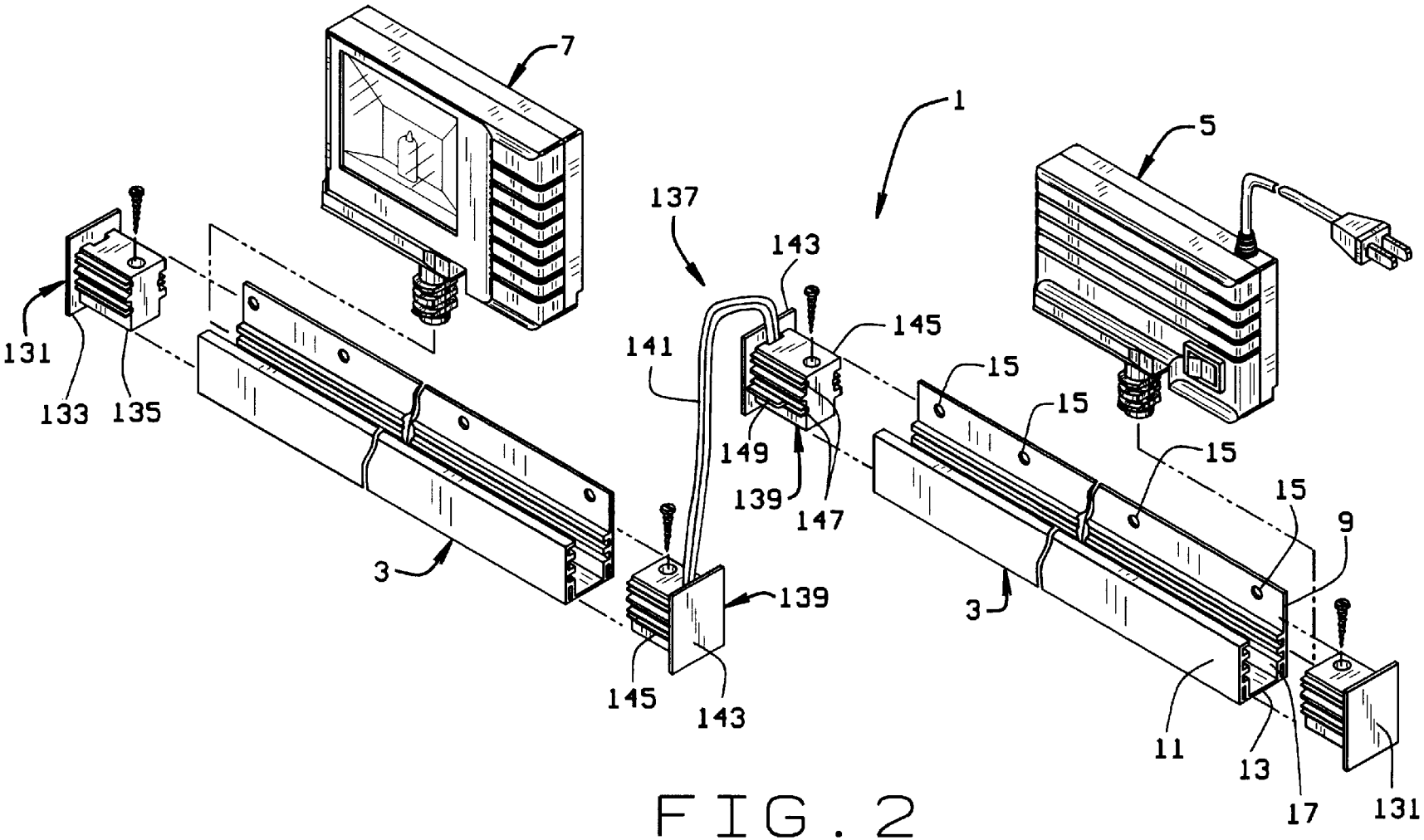
FIG. 2 is an exploded view of the components of the track-lighting system.
Figure 3:
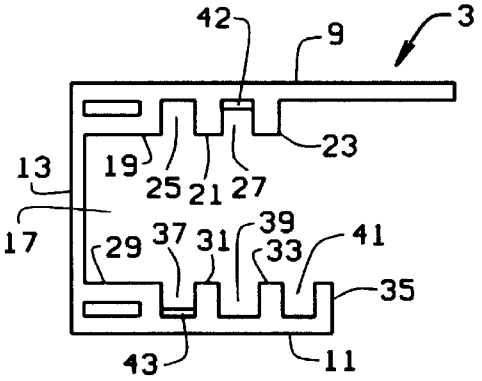
FIG. 3 is a side elevational view of the track of the track lighting system.
Figure 5:
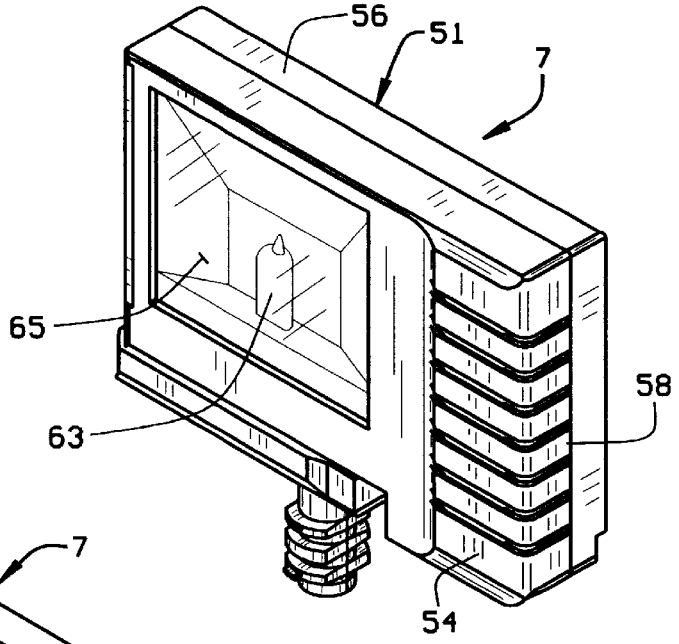
FIG. 5 is a perspective view of the light fixture.
Figure 6:
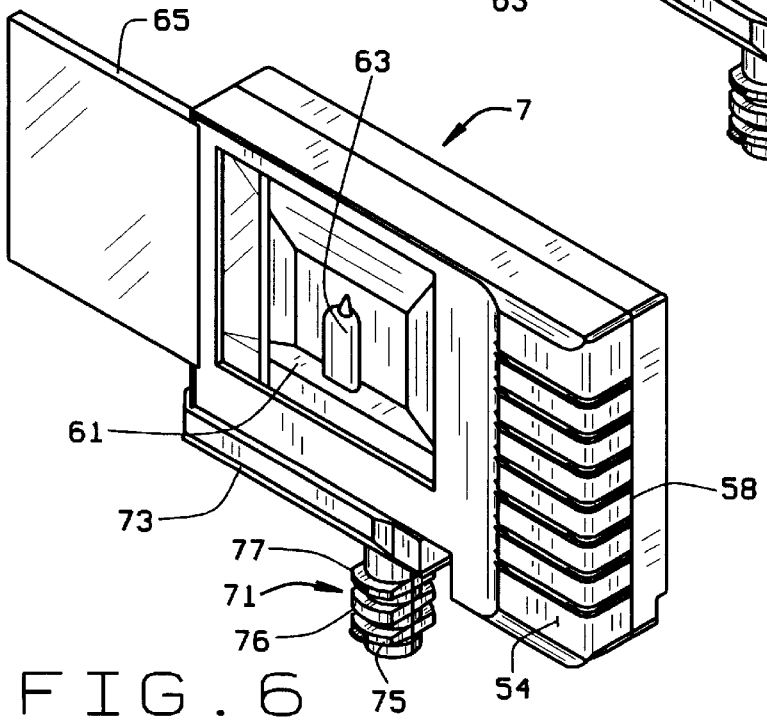
FIG. 6 is a perspective view of the light fixture, showing a slidable glass cover removed to allow for changing of the bulb of the lamp.

The track 3 (shown in detail in FIG. 3) is made of an electrically non-conductive material, such as plastic, and includes an upper wall 9, a lower wall 11, and a side wall 13. The upper wall 9 is deeper than the bottom wall 13 and includes a plurality of screw holes 15 (FIG. 2) through which a screw can pass to mount the track 3 to the bottom of the cabinet C. The walls 9, 11, and 13 of the track define a main channel 17 which extends the length of the track, and is open at either end of the track as well as along the front of the track. The top wall has a step 19 adjacent the side wall 13 and two ribs 21 and 23 extending inwardly from the top wall 9. The step 19, and the ribs 21 and 23 cooperate to define two grooves 25 and 27 extending the length of the top wall of the track 3. The bottom wall 11 includes a step 29 adjacent the side wall 13, two ribs 31 and 33, and an inner wall 35. The step 29, ribs 31 and 33, and inner wall 35 cooperate to define three grooves 37, 39, and 41 which extend the length of the bottom wall. The steps 19 and 29 are of the same size; the ribs 21 and 31 are directly opposite each other, as are the ribs 23 and 33. Thus, the grooves 25 and 27 are directly opposite the grooves 37 and 39. A copper ribbon 42 (i.e. an electrically conductive element) is placed in the groove 27 on the inner surface of the upper track wall 9 and a second copper ribbon 43 is placed in the groove 37 on the inner surface of the bottom track wall 11. The grooves 25 and 37 can be considered a first groove pair and the grooves 27 and 39 can be considered a second groove pair. The positioning of the copper ribbons 42 and 43 places a copper ribbon in each groove pair. Although the copper ribbons are shown one against the top wall and one against the bottom wall, they can both be placed against the same wall, if desired.

The light fixture 5 (FIGS. 4–10) includes a housing 51 having a top surface 53, a bottom surface 54, a front surface 56, a back surface 57, a first side 58, and a second side 59. A recess 61 is formed in the bottom surface 54 to house a bulb or lamp 63. A transparent panel 65, such as a glass or Plexiglas panel, slides in a slot extending inwardly from the second side 59 to cover the bulb. A side panel 67 (FIG. 9) on side 59 slides to uncover the slot so that the panel 65 can be moved to change the lamp 63 when necessary.

Figure 8:
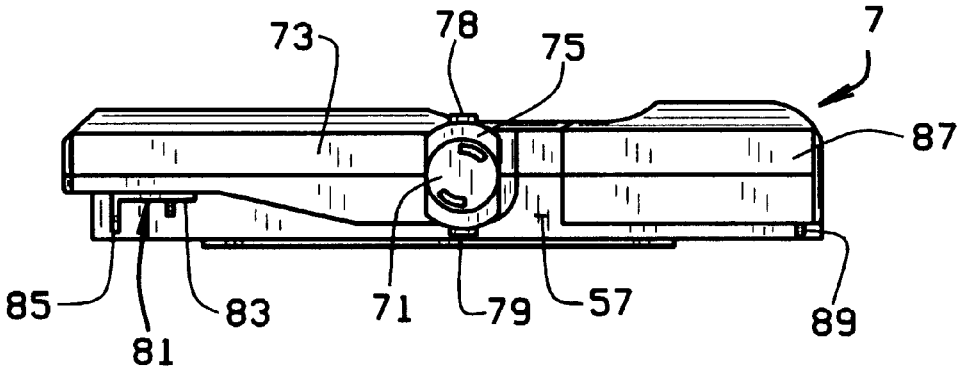
FIG. 8 is a rear elevational view of the light fixture.

A mounting arm 71 extends from the back surface 57 of the housing to mount the light fixture 7 to the track 3 and to electrically connect the light fixture to the copper ribbons 41 and 43 to supply current or power to the lamp 63. The mounting arm 71 rotates relative to the housing and is rotated by a locking arm 73. The mounting arm 71 includes three spaced apart flanges 75, 76, and 77 which extend perpendicularly or radially from the mounting arm 71. The flanges 75–77 do not extend circumferentially around the arm 71. Rather, they each have a top portion and a bottom portion which are sized and shaped to be received in the grooves of the track. As best seen in FIG. 8, the flanges each have a portion which is thicker at one end than the other. That is, the upper half of flanges 75 and 77 is thicker than the lower half, and the lower half of flange 76 is thicker than the upper half. Thus, flange 76 is inverted relative to flanges 75 and 77. The wider or thicker half of the flanges 75–77 has a width slightly less than the width of the track grooves 25, 27, 37, 39, and 41. The narrower or thinner half of the flanges have a width narrower than that of the grooves. The flanges 75–77 each have a height from top to bottom approximately equal to, but slightly less than, the height of the track 3 between the top wall 9 and the bottom wall 11. The flanges 75 and 77 further have electrical contacts 78 and 79 which are in electrical communication with the lamp 63 to form an electrical circuit in the light fixture 7. The contacts 78 and 79 are preferably formed in the narrow half of the flanges 75 and 76.

Figure 7:
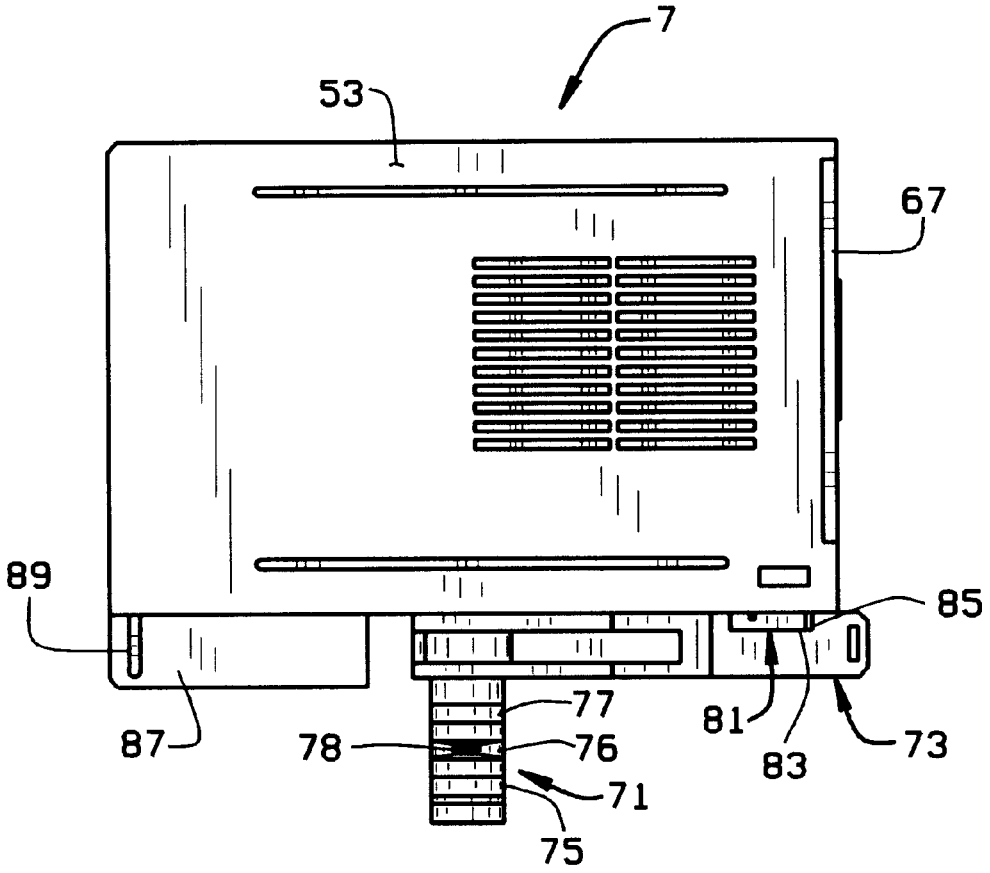
FIG. 7 is a top plan view of the light fixture.
Figure 9:
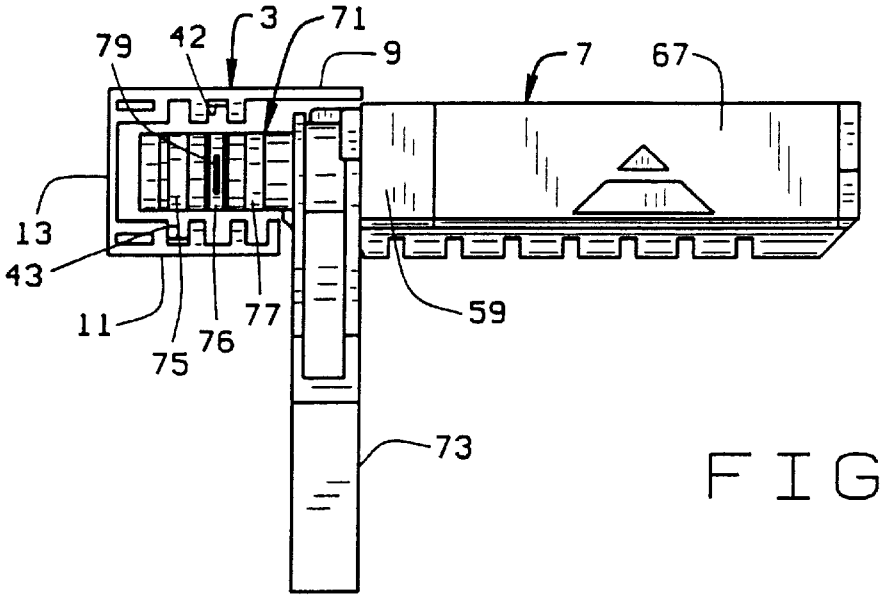
FIG. 9 is an end elevational view of the lamp in a track with a locking arm in an unlocked position, the lighting fixture being inserted in a track to mount the lighting fixture in the track.
Figure 10:
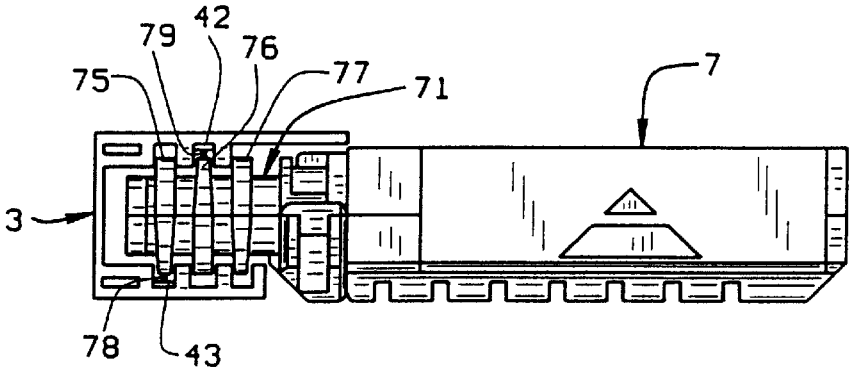
FIG. 10 is a view similar to the view of FIG. 9, but with the locking arm in a locked position to fix the lamp in the track at a desired location along the track.

To insert the light fixture 7 into the track 3, and to secure it in place in the track, the mounting arm 71 is rotated to a first position by the locking arm 73 by rotating the arm 73 downwardly relative to the light fixture 7 to the position shown in FIG. 9. In this position, the flanges 75–77 are generally parallel to the channel 17 and the grooves of the track, as seen in FIG. 7. The mounting arm 71 is inserted in the track's main channels 73 with the flange 75 generally aligned with the first groove pair (grooves 27 and 37), with the flange 76 generally aligned with the second groove pair (grooves 27 and 39), and with the third flange 77 generally aligned with the groove 41. The light fixture is moved along the track to its desired position on the track. At that point, the locking arm 73 is pivoted upwardly relative to the light fixture 7 to the position shown in FIG. 10. This rotates the mounting arm 71 so that the flanges 75–77 are generally perpendicular to the channel 17 and the track grooves. When the mounting arm 71 is rotated to its locking position, the contacts 78 and 79 engage the copper ribbons 42 and 43 to electrically connect the light fixture 7 to the track 3. Further, the size of the flanges 75 and 76 (in combination with the height of the contacts 78 and 79) creates a friction fit in the track between the flanges and the track upper and bottom walls to hold the light fixture in place in the track.

The light fixture 7 includes an L-member 81 (FIGS. 7 and 8) on the back side 57 of the light fixture housing. The L-member includes a first leg 83 which is generally parallel to the plane of the top and bottom surfaces of the light fixture housing and a second leg 85 which is perpendicular to the first leg 83. The locking arm 73 rests against the first leg 85 when the locking arm is in the locking position as seen in FIGS. 7 and 8. The first leg 85 thus acts as a stop to prevent the locking arm from being pivoted too far. When the lighting fixture 7 is placed in the track 3, the end of the second leg 85 abuts the top wall 9 of the track 3. The lighting fixture also includes an step 87 extending from the housing back surface 57 which extends into the track channel 17 when the lighting fixture is applied to the channel. The step 87 has a bottom surface generally flush with the bottom surface of the housing. However, the step is not as deep (from top-to-bottom) as the fixture, and the top surface of the step is not flush with the top surface of the housing, as seen in FIG. 8. A lip 89 extends from the back surface 57 of the housing, along the top surface of the step. The lip 89, like the second leg 85, engages the top wall 15 of the track 3 when the light fixture 7 is applied to the track 3. As can be appreciated, the second leg 85 and the lip 89 are sized so that their top edges are co-planar. They thus serve as leveling devices so that the light will be generally level (or parallel to the axis of the track 3) when it is applied to the track 3.

Figure 1:
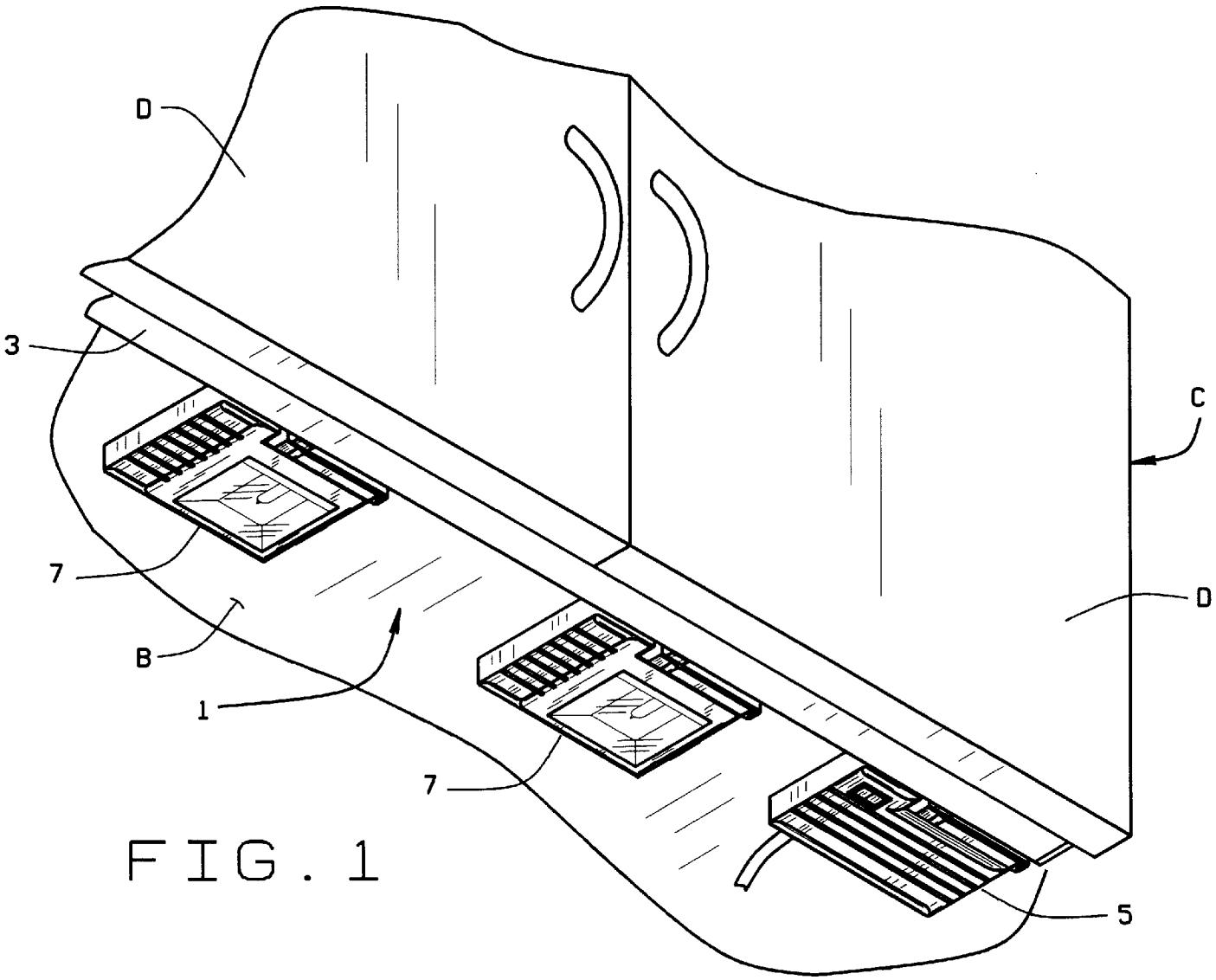
FIG. 1 is a bottom perspective view of an under the cabinet track-lighting system of the present invention mounted to the underside of a cabinet.

The lighting fixture 7 does not have its own power supply. Rather, the power supply 5 is separate and physically independent of the lighting fixture 7. One embodiment of the power supply 5 is shown in FIG. 1. The power supply has a housing 91 having top, bottom, front, back and side walls. A mounting arm 95 extends from the back wall of the housing to be rotatable relative to the housing. The mounting arm 95 is rotated by a locking arm 97. The mounting arm 95 and locking arm 97 are identical to the mounting arm 71 and locking arm 73 of the light fixture. They will thus not be further described, except as to note the contacts 98 and 99 which project from the flanges of the mounting arm. The mounting arm 95 and locking arm 97 operate identically to the lighting fixture's mounting arm 71 and locking arm 73 to mount and lock the power supply 5 to the track 3. The power supply 5 also includes the L-member 99 and the lip 101, corresponding to the L-member 81 and lip 89 of the light fixture, to position the power supply 5 in the track so that that power supply will be generally parallel to the longitudinal axis of the track 3. Importantly, there are no fasteners which directly connect the power supply 5 to the surface to which the track is mounted. Thus, the power supply 5 is supported by the track 3.

The power supply 5 also includes a power cord 101 which connects to the electrical system of the house in which the track lighting system 1 is installed. The cord 101 my be wired directly into the electrical system, or may include a plug 103 which is received in an electrical outlet of the house. An on/off switch 104 is provided to turn on and off the lights, as is known. As can also be appreciated, the power supply includes an electronic circuit (not shown) as is known in the art. The power cord 101, on/off switch 104 and the contacts 98 and 99 define an electrical circuit in the power supply. Thus, when the on/off switch is switched to its "on" position, the power supply will electrify the track 3 to provide power to the light fixtures 7.

Because the power supply 5 can be mounted at any desired location along the track 3, a single power supply 5 can energize a greater length of track than if the power supply were electrically connected to the track at the end of the track. By mounting the power supply in a center portion of the tract (rather than at an end of the track), the energy from the power supply will travel in two directions from the power supply (rather than just one direction). Because the energy does not have to travel the full length of the track, the energy provided by the power supply will not be reduced to the same level by the resistance in the copper ribbons 42 and 43 by the time the energy reaches the ends of the track. Therefore, a power supply can be used to energize additional lengths of track or to power additional fixtures.

Further, the ability to position the power supply at a desired location along the track will allow more freedom in positioning the track beneath a cabinet or on a wall or ceiling. That is, less attention need be paid to the position of the electrical connection for the power supply when positioning the track. The power supply can simply be fixed to the track at a position which is most convenient for making the electrical connection for the power supply (i.e., plugging the power supply into the wall or hard wiring the power supply into an electrical circuit in the building).

Figure 11:
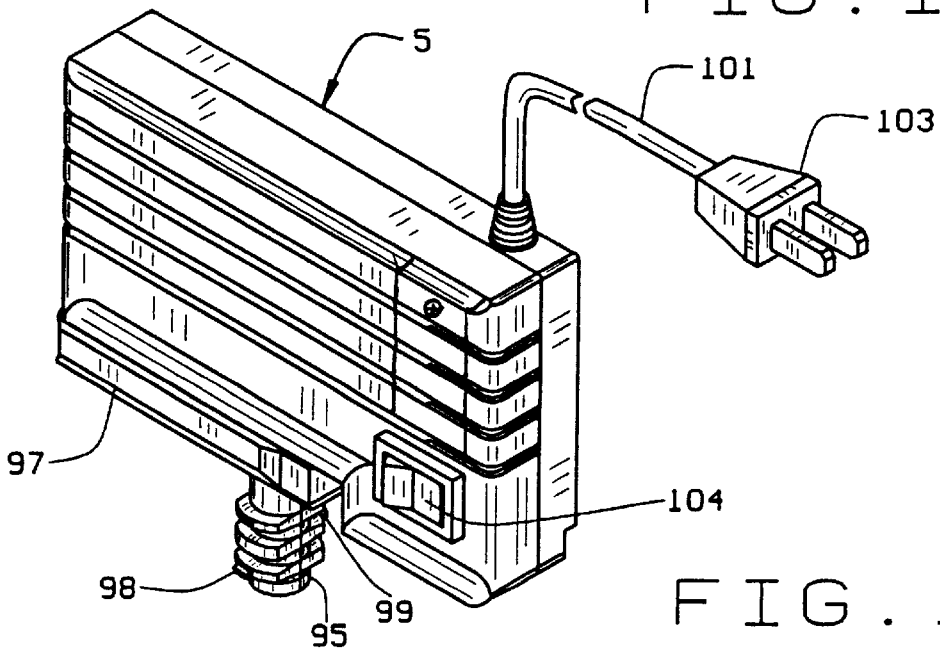
FIG. 11 is a perspective view of a power supply for the track light.
Figure 12:
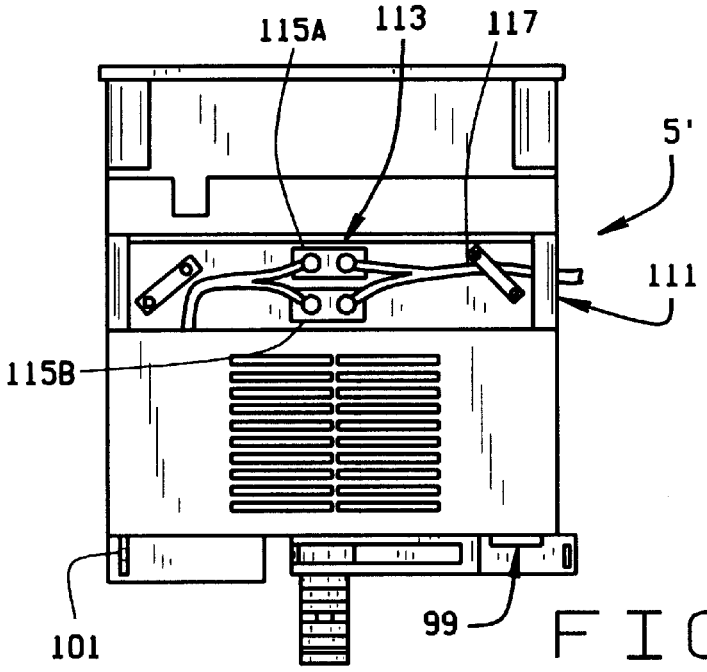
FIG. 12 is a back plan view of a second embodiment of the power supply, the power supply being provided with a wire splice compartment.
Figure 13:
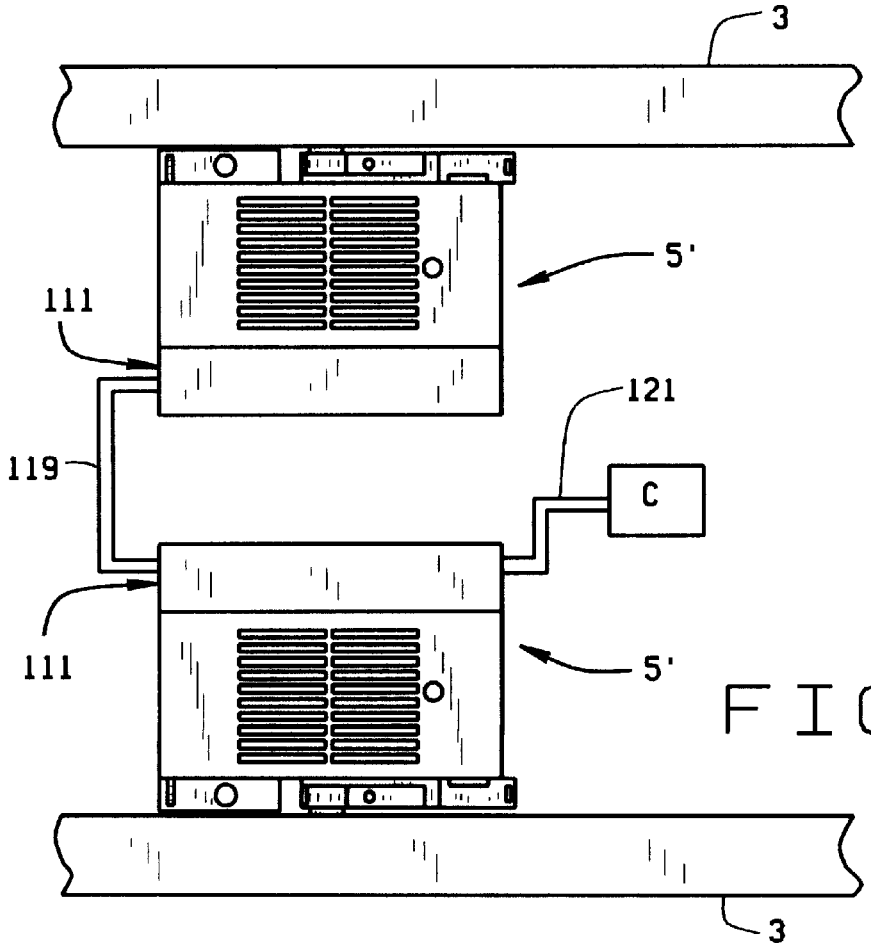
FIG. 13 is a diagrammatic view of two power supplies being connected in parallel through their respective wire splice compartments.

A second embodiment 5' of the power supply is shown in FIG. 12. The power supply 5' is substantially identical to the power supply 5 of FIG. 11. However, the power supply 5' is additionally provided with a wire splice compartment 111. The wire splice compartment 111 includes a wiring grid 113 having two pair of contacts 115A,B. The contacts 115A,B are electrically connected on one side to the electrical circuit of the power supply by wires 116. A wire 117 is electrically connected to the other side of the contacts 115A,B. The use of the optional wiring splice compartment allows for two or more power supplies to be electrically connected in parallel, as shown in FIG. 13. The power supply 5 is provided with a cord having a plug at its end to be plugged into an electrical outlet. The power supply 5' on the other hand, is wired directly to an electrical circuit C in the building in which the track lighting system is installed. By providing the wire splice compartment 111, several power supplies 5' can be electrically connected in parallel by an electrical wire 119 extending between the wiring grids 115 of the respective wire splice compartments 111. Then all the power supplies can be connected to the electrical circuit of the house by connecting a first of the electrically connected power supplies by an electrical line 121. This will enable multiple tracks 3 which are independent of each other to be made operable through a minimum of connections into the electrical system of the building.

Installation of the track lighting system 1 is fairly straight forward. Initially, the track 3 is installed beneath a cabinet C using screws which extend through the holes 15 in the track top wall 9. A desired number of light fixtures 7 and the power supply 5 are positioned on the track at desired locations along the track. Because the power supply is independent of the light fixtures 7 and is independently mounted to the track 3, the power supply 5 need not be mounted at the end of the track, as are transformers in currently available track lighting systems. Rather, the power supply can be mounted in any convenient location along the track 3, for example along the middle of the track near where an outlet is located. Once the power supply 5 and light fixtures 7 have been positioned along the track, the ends of the track 3 are closed with covers 131. The covers 131 each include a cover plate 133 and a body 135 made from an electrically non-conductive material and sized and shaped to be received in the channel 17 and grooves 25, 27, 37, 39, and 41 of the track 3 to substantially prevent any of the copper ribbons 41 and 43 from being exposed.

If more than one track length is needed, or if the track lighting system extends around a corner, a connector 137 is used to connect the two pieces of track 3. The connector 137 includes two end pieces 139 which are electrically connected by an electrical cable 141. The end pieces 139 each include a cover plate 143 and a body 145 which are made from an electrically non-conductive material. The body 145 is shaped similarly to the body of the end covers 131 and include ribs 147 sized and shaped to extend into the grooves 25, 27, 37, 39, and 41 of the track 3. The ribs 147 however include contacts 149 at their outer edges which engage the copper ribbon of the track 3 when the connectors are placed in the track 3. The contacts 149, as can be appreciated, are electrically connected to the cable 141. Thus, the contacts of the two end pieces 139 are electrically connected. Therefore, a single power supply, when activated, will energize all the track 3 which is made part of the track lighting system.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. Although the copper ribbon of the track is positioned against the top and bottom walls of the track, one or both of the copper ribbons could be placed along the back wall of the track. This would require that a groove be formed along the back wall to electrically isolate the ribbon. It would also require that one or both of the mounting arm contacts of the power supply and the lighting fixture be placed along the back side of the mounting arm. These examples are merely illustrative.

I claim:

1. A track-lighting system including an electrically conductive track, a power supply adapted to be mounted to the track at a desired position along the track to energize the track, and at least one lighting fixture adapted to be mounted to the track at a desired position along the track; the track including two electrically conductive elements which extend substantially the length of the track, the two electrically conductive elements being electrically isolated from each other; the lighting fixture being independent of the power supply; the at least one lighting fixture and power supply each including contacts which engage the electrically conductive elements of the track when they are mounted in the track; the at least one lighting fixture being electrically connected to the power supply by the electrically conductive track to be powered by the power supply.

2. The track-lighting system of claim 1 wherein said track includes a top wall, a bottom wall, and a side wall defining a main channel extending the length thereof and a groove formed in each of said top wall and bottom wall;

said power supply including a housing, a power cord extending from said housing for connecting said power supply to a source of energy, a power supply mounting arm extending from said housing to be received in said channel, said power supply mounting arm including a flange extending radially from said arm, said flange being received in said groove;

the mounting arm of the power supply being rotatably mounted to the power supply, the mounting arm being rotatable between a first position in which the mounting arm flanges are generally parallel to an axis track and the groove and a second position in which the mounting arm flanges are generally perpendicular to the axis of the track; the flanges having a height such that when the mounting arm is rotated to the second position, the flanges will be in operative engagement with the top and bottom walls of the track to fix the power supply and lighting fixture in place along the track.

3. The track lighting system of claim 2 wherein the power supply includes a locking arm extending from the mounting arm, said locking arm being pivotal relative to said housing between a first and second position to rotate said locking arms between their first and second positions.

4. The track lighting system of claim 1 wherein the power supply includes a wire splice compartment; the wire splice compartment including a wiring grid which is electrically connected to the power supply; the wire splice compartment facilitating electrical connection of the power supply to a second power supply by means of an electrically conducting wire extending between the wire splice compartments of respective power supplies.

5. Thc track lighting system of claim 4 wherein the power supply is directly and electrically connected to an electrical circuit in a building in which the track lighting system is installed.

6. In a track lighting system including an electrically conductive track, a light fixture mountable to the track, and a power supply mountable to the track to energize said track, the improvement comprising said power supply; said power supply being adapted to be mounted to the track at a desired location along the track;

said track including a top wall, a bottom wall, and a side wall defining a main channel extending the length thereof and a groove formed in each of said top wall and bottom wall;

said power supply including a housing, a power supply mounting arm extending from said housing to be received in said channel, said power supply mounting arm including a flange extending radially from said arm, said flange being received in said groove;

the mounting arm of the power supply being rotatably mounted to the power supply housing, the mounting arm being rotatable between a first position in which the mounting arm flanges are generally parallel to an axis track and the groove and a second position in which the mounting arm flanges are generally perpendicular to the axis of the track; the flanges having a height such that when the mounting arm is rotated to the second position, the flanges will be in operative engagement with the top and bottom walls of the track to fix the power supply and lighting fixture in place along the track.

7. The improvement of claim 6 wherein the power supply includes a locking arm extending from the mounting arm, said locking arm being pivotal relative to said housing between a first and second position to rotate said locking arms between their first and second positions.

8. A track lighting system comprising:

an electrically conductive track including a pair of spaced apart grooves extending the substantially the full length of the track and a conductor in each of the grooves;

a light fixture mountable to the track; and a power supply mountable to the track to energize said track; said power supply including a housing, a rotatable power supply mounting arm extending from said housing to be received in said track, said power supply mounting arm including a pair of contacts extending radially from said arm, said contacts being positioned on said arm such that one contact is received in each of said grooves; said power supply mounting arm being rotatable between a first position in which said arm can be moved along said track and a second position in which said contacts are in electrical contact with the conductors in said grooves.

* * * * *